US011655010B2

(12) United States Patent
Meyer et al.

(10) Patent No.: US 11,655,010 B2
(45) Date of Patent: May 23, 2023

(54) ASSEMBLY OF A VESSEL AND A TURRET

(71) Applicant: BLUEWATER ENERGY SERVICES B.V., Hoofddorp (NL)

(72) Inventors: Jan Anton Daniel Meyer, Almere (NL); Patrizio Giovanni Matia Ottolini, Voorhout (NL)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 197 days.

(21) Appl. No.: 17/118,203

(22) Filed: Dec. 10, 2020

(65) Prior Publication Data

US 2021/0179240 A1 Jun. 17, 2021

(30) Foreign Application Priority Data

Dec. 13, 2019 (EP) ..... 19215907

(51) Int. Cl.
*B63B 21/20* (2006.01)
*B63B 21/04* (2006.01)
*B63B 73/30* (2020.01)

(52) U.S. Cl.
CPC ..... *B63B 73/30* (2020.01); *B63B 21/04* (2013.01); *B63B 21/20* (2013.01)

(58) Field of Classification Search
CPC ..... B63B 73/30; B63B 21/04; B63B 21/20; B63B 21/507
USPC ..... 114/230.12
See application file for complete search history.

(56) References Cited

U.S. PATENT DOCUMENTS

| | | | |
|---|---|---|---|
| 4,305,341 | A | 12/1981 | Stafford |
| 4,701,143 | A | 10/1987 | Key et al. |
| 4,841,895 | A | 6/1989 | Brewerton |
| 4,955,310 | A | 9/1990 | Pollack |
| 5,065,689 | A | 11/1991 | Krogstad |
| 5,178,087 | A | 1/1993 | O'nion et al. |
| 5,381,750 | A | 1/1995 | Pollack |

(Continued)

FOREIGN PATENT DOCUMENTS

| | | | |
|---|---|---|---|
| EP | 0259072 | A1 | 3/1988 |
| EP | 0656293 | A | 6/1995 |

(Continued)

OTHER PUBLICATIONS

European Search Report for European Patent Application No. 119215907.7, dated Jun. 5, 2020.

*Primary Examiner* — Anthony D Wiest
(74) *Attorney, Agent, or Firm* — Steven M. Koehler; Westman, Champlin & Koehler, P.A.

(57) ABSTRACT

An assembly of vessel and turret is provided. The vessel comprises a moonpool and the turret is mounted in said moonpool for a rotation around a turret axis relative to the vessel. The turret comprises a chain table to which mooring lines are connected and through which risers are conveyed, and a turret table vertically spaced above the chain table and connected therewith by a connecting structure. The connecting structure comprises at least three vertically extending columns positioned such at angular intervals that radially outer sides of the columns are located in the vicinity of an outer circumference of the turret. The risers are conveyed through the chain table in such a way that riser sections above the chain table extend towards the turret table within an internal space of the columns.

21 Claims, 3 Drawing Sheets

(56) References Cited

U.S. PATENT DOCUMENTS

| | | | | |
|---|---|---|---|---|
| 5,893,784 | A | 4/1999 | Boatman | |
| 6,588,357 | B1 * | 7/2003 | Hobdy | B63B 21/507 114/230.1 |
| 6,708,639 | B2 | 3/2004 | Cottrell et al. | |
| 6,990,917 | B2 * | 1/2006 | Boatman | E21B 19/004 114/230.12 |
| 7,225,749 | B2 | 6/2007 | Boatman | |
| 7,451,718 | B2 * | 11/2008 | Boatman | B63B 22/026 441/3 |
| 7,690,434 | B2 * | 4/2010 | Baross | B63B 21/507 441/5 |
| 9,108,702 | B2 | 8/2015 | Ottolini | |
| 2002/0073906 | A1 | 6/2002 | Hobdy | |
| 2003/0121465 | A1 | 7/2003 | Boatman et al. | |
| 2003/0154899 | A1 | 8/2003 | Cottrell et al. | |
| 2004/0261683 | A1 | 12/2004 | Lindblade et al. | |
| 2005/0061224 | A1 | 3/2005 | Boatman | |
| 2014/0216322 | A1 | 8/2014 | Ottolini | |

FOREIGN PATENT DOCUMENTS

| | | | |
|---|---|---|---|
| WO | 8706555 | A1 | 11/1987 |
| WO | 8903338 | A1 | 4/1989 |
| WO | 2012163394 | A1 | 12/2012 |

* cited by examiner

ASSEMBLY OF A VESSEL AND A TURRET

BACKGROUND

The discussion below is merely provided for general background information and is not intended to be used as an aid in determining the scope of the claimed subject matter. Aspects of the invention relate- to an assembly of a vessel and a turret, wherein the vessel comprises a moonpool and wherein the turret is mounted in said moonpool for a rotation around a turret axis relative to the vessel, which turret comprises a chain table to which mooring lines are connected and through which risers are conveyed, and a turret table vertically spaced above the chain table and connected therewith by a connecting structure.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of present invention is a connecting structure comprising at least three vertically extending columns positioned such at angular intervals, and preferably at regular angular intervals, that radially outer sides of the columns are located in the vicinity of an outer circumference of the turret and wherein the risers are conveyed through the chain table in such a way that riser sections above the chain table extend towards the turret table within an internal space of the columns.

The columns, at one hand, provide sufficient constructional strength, for example by means of stiffened plating, web frames and stringers, such that, among others, mooring forces introduced by the mooring lines at the chain table are effectively transferred to the turret table or to other parts in the vicinity of the turret table, such as for example a bearing which is positioned in the moonpool and rotatably connects the turret to the vessel. On the other hand the columns may provide a protected environment for the riser sections extending upwards from the chain table (but also for other components provided at such a location, for example (emergency shutdown) valves, piping and other equipment).

Compared to an assembly in which the turret would comprise a circumferential wall which would define a single cylindrical or one column-like, for example closed, structure, the provision of at least three smaller columns allows to prevent a large increase of the buoyancy of the turret, while still offering sufficient space for accommodating risers, even if the number of risers is increased.

It is noted that the indication 'riser sections' also encompasses pipe sections connecting to upper endings (riser endings) of the risers in the vicinity of (and in many cases just above) the chain table, and as such not necessarily denotes integral parts of the risers. However, likewise it is conceivable that the indication 'riser' denotes several parts, flexible but also non-flexible (hard piping), valves and other pipe equipment up to or above the turret table. The indication 'regular angular intervals' does not necessarily require that all angular intervals are equal. As will appear later, this indication also may denote the use of differing angular intervals, but provided in a regular pattern. The indication 'in the vicinity of an outer circumference of the turret' could mean that the respective radially outer sides of the columns define a part of such an outer circumference, but also that they are slightly spaced therefrom. In general a more outward position yields a more effective design with respect to the transfer of loads.

In one embodiment the columns at least in their lower parts connecting to the chain table define an internal space sealed against the surroundings.

Whereas in general the provision of a protected environment, as stated above, also may encompass an embodiment in which the columns protect the riser sections against external influences, such as impacts, without fully isolating (or shielding) the riser sections from the surroundings, this embodiment provides for such an isolation (or sealing) of the riser sections with respect to the surroundings. For example, given a specific water level (sea level) in the moonpool under operational conditions of the assembly, said lower parts of the columns which define said internal space sealed against the surroundings may extend upwards to at least said water level (and preferably higher for coping with waves and splashing sea water), such that the riser sections below the water level will be protected against the sea water (and against resulting pressure variations, drag loads etc.). This, however, not only protects the respective riser sections, but also may provide protection to other equipment and to personnel, both during riser installation and during operation or maintenance of the assembly.

It is noted that 'sealed against the surroundings' does not necessarily require that said lower parts of the columns are fully closed (it is conceivable, for example, that they are at least partially open at the top).

However, in a specific embodiment the columns over their entire vertical extension between the chain table and turret table define an internal space sealed against the surroundings.

This offers an optimal protection of the riser sections between the chain table and turret table. In such an embodiment it is possible to provide atmosphere control equipment, for example ventilation equipment, for controlling the atmosphere within the internal space. As a result the built up of a hazardous mixture (e.g of gas/oil and air, for example caused by (accidental) leaking of the riser sections, especially at riser endings) may be prevented to ensure a safe working environment and to avoid hazardous situations.

In one embodiment of the assembly the dimensions of the internal space are sufficient to allow access of a person (or a number of persons) with or without equipment and/or material into said internal space and access devices to the internal space are provided, such as preferably an access door.

Also other provisions may be made to assure that said person(s) may reach the required places within the columns, such as for example ladders and stairways (or even an elevator).

In one embodiment the columns at a vertical spacing above the chain table are provided with support members, preferably hang-off supports, for supporting the risers. The vertical spacing may be such, that the support members are located at or in the vicinity of the level of the turret table. These support members in a very effective way introduce riser loads into the turret. These support members also may be used in a similar manner to support umbilicals.

For example, such support members may be (part of) a horizontally extending bulk head (which then may support hang-off supports).

In one embodiment emergency shut down valves for the risers are located in the vicinity of the chain table or turret table (preferably just above the chain table).

Generally it is a desire to position such emergency shut down valves as close as possible to the riser endings and with the aid of the present design of the columns this is possible.

In one embodiment the columns, at least in their lower parts connecting to the chain table, have a tapering shape with a wider part near to the chain table and a narrower part at a higher level. Such a tapering shape preferably will be defined (at least) at the radially outer sides of the columns. This may provide constructional advantages while limiting the use of material (and thus limiting the overall weight).

It then is conceivable that the risers enter the turret from below the chain table at most under a maximum angle which substantially corresponds with the tapering shape.

In one embodiment the mooring lines, as viewed in a vertical direction, are connected to the chain table at locations between the columns.

This means that a horizontal cross section of the turret may be divided into imaginary first sectors in which the columns are provided and imaginary second sectors located between first sectors where the mooring lines are connected to the turret (thus in a circumferential direction providing an alternation of first and second sectors). As a result the risers and mooring lines will never interfere with each other, also not in the event of an (unwanted) detachment of a riser or mooring line.

In one embodiment the sides of the columns, as viewed in a horizontal cross section, are defined by two straight lines extending radially outwards from the turret axis and enclosing an angle, an inner circle segment extending between said two straight lines concentrically around and at a distance from the turret (centre) axis, and an outer circle segment extending between said two straight lines concentrically around the turret axis and in the region of the outer circumference of the turret. A circle segment, in this context, also may be approximated by a (large) number of (short) straight sections including angles with each other.

In a specific embodiment the assembly comprises at least three columns and the angle preferably is about 60 degrees. This would yield three imaginary first sectors of 60 degrees and three imaginary second sectors of 60 degrees. However, also more columns may be provided, yielding more imaginary first and second sectors (which may span equal or different angles, as may also be the case where just three columns are provided). Whatever the embodiment, it is preferred that the angular spacing between successive columns has a regular pattern. Thus, the angular spacing may be constant, but as a non-limiting example of a different pattern an embodiment may be mentioned with eight columns which are grouped in four groups of each two columns with a first angular spacing between the columns of a group and with a second different angular spacing between the groups.

In a practical embodiment, the turret for example may have a diameter between 15 and 20 meters, wherein the length of the straight lines between the inner and outer circle segments is between 4 and 6 meters, and wherein preferably the turret has a diameter of about 17 meters and the length of the straight lines between the inner and outer circle segments is about 5 meters.

In the event that the chain table comprises vertically extending bulk heads, it may be advantageous when the sides of the columns defined by the straight lines are (upwardly extending) prolongations of said bulk heads. This allows to keep the construction as simple as possible, to reduce the number of parts, to limit the overall weight and to create effective paths for the transfer of loads (also resulting in loading a main bearing very evenly, thus reducing its wear and fatigue).

Likewise, in the event that the turret table comprises vertically extending bulk heads, the sides of the columns defined by the straight lines may define (downwardly extending) prolongations of said bulk heads, achieving similar benefits.

An aspect of the invention also provides an embodiment of the assembly wherein in the moonpool, substantially at the level of the turret table, a main (or upper) bearing is provided between the turret and the vessel and wherein there is not provided an additional (or lower) bearing at a lower level, or there is provided a fail-safe bearing, preferably a sliding bearing, at a lower level, preferably substantially at the level of the chain table, having cooperating bearing parts at the turret and at the vessel which under design operational conditions do not engage each other.

As stated before, the design with the columns allows an effective transfer of loads towards the turret table or, in this case, to the main (or upper) bearing, such that an additional (lower) bearing at a lower level is not necessary. However, for safety reasons it may be desired to provide a fail-safe bearing at such a lower level which only will become active under extreme conditions. Such a fail-safe bearing for example may be a low-cost sliding bearing with, in the moonpool, a sliding ring on the vessel and slide pads on the turret (or vice versa) which under normal conditions are spaced from each other and thus do not contact each other but which may engage each other when the turret (or vessel) experiences extreme loads and/or deformations.

In one embodiment the risers comprise any type of riser configurations and in particular steel, plastic or composite lazy wave risers.

Using the design, loads from such lazy wave risers are very effectively introduced into and transferred by the turret, and thus into the vessel. Further the design allows to end the risers, which normally end at the level of the turret table (at riser endings), at a lower elevation close to the chain table, which results in the possibility to use such a lazy wave design for the risers and the placement of emergency shut down valves close to the riser endings.

BRIEF DESCRIPTION OF DRAWINGS

Hereinafter aspects of the invention will be elucidated while referring to the drawings, in which.

DETAILED DESCRIPTION OF THE ILLUSTRATIVE EMBODIMENT

Figure 1:
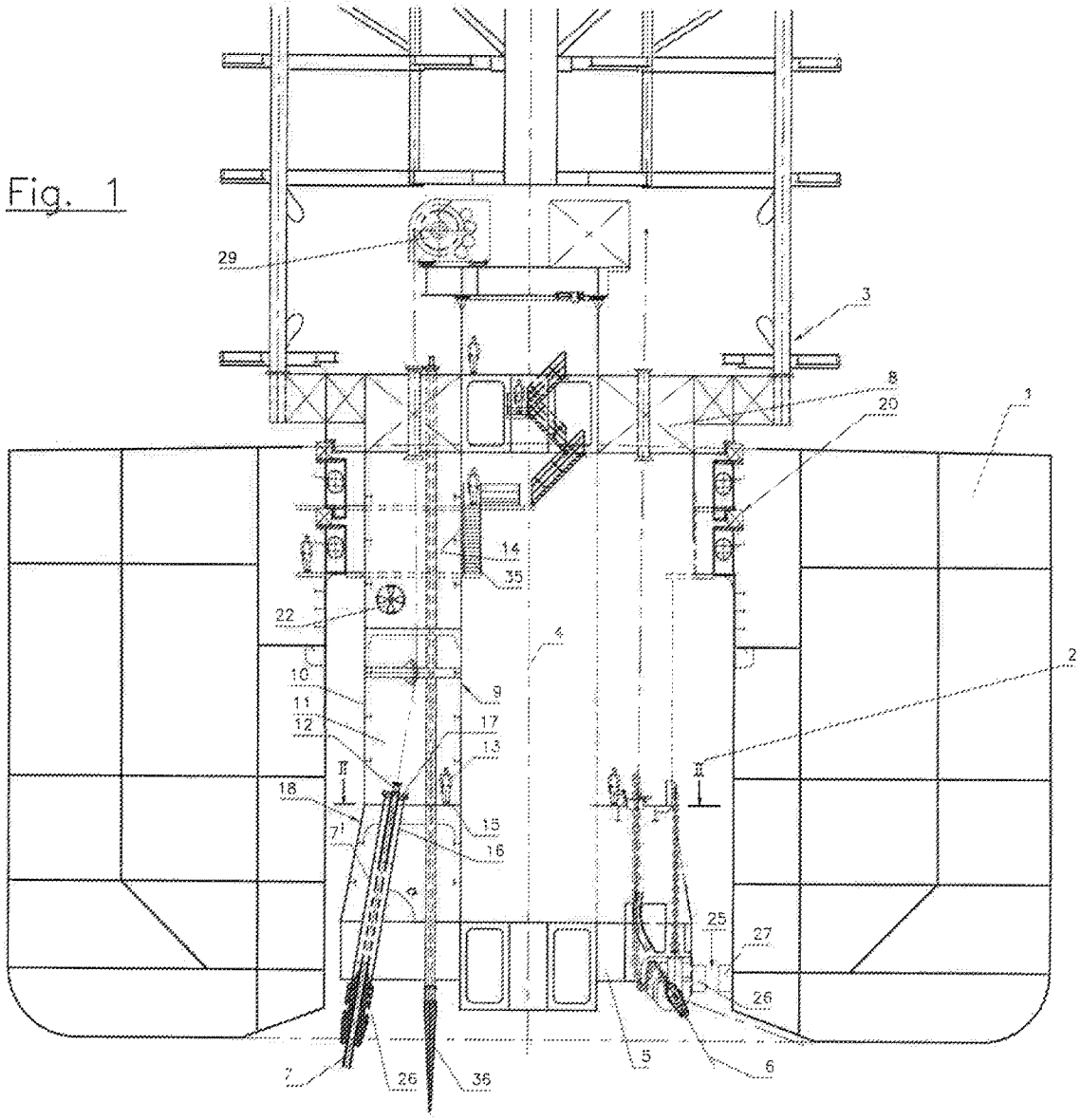
FIG. 1 illustrates a schematic vertical cross section of an assembly.

In FIG. 1 a schematic cross-sectional representation is illustrated of an embodiment of an assembly in accordance with an aspect of the present invention. In a vessel 1 a moonpool 2 is provided in which a turret 3 by means of a main (upper) bearing 20 (which may have a twin design) is mounted for a rotation relative to the vessel around a central turret axis 4. The turret 3 in its lower part comprises a chain table 5. Mooring lines (such as mooring chains or wires or a combination thereof) 6 are connected to the chain table 5 (directly or indirectly in a manner known per se and not further discussed here) and thus keep the turret 3 moored in a specific rotational position with respect to a fixed point, such as the sea bed (although generally slight horizontal movements of the turret 3 will be allowed).

Such a design generally will be used to moor the vessel 1 while allowing it to weathervane around the turret 3, as is well-known in the field of oil and gas production.

The chain table 5 further defines an access for risers 7 which are conveyed through dedicated passages in the chain table and upward to a turret table 8 which is located in the turret at a higher level, vertically spaced from the chain table 5. The turret table 8 may support equipment, such as manifolds and swivels, needed for the operation of the turret 3, for example a lift 29 for pulling in a riser 7 and mooring lines 6.

The risers 7 (which may comprise a combination of lead-in and flex-joint members 26 near to the chain table 5 for leading in a riser 7 and for preventing an excessive degree of bending of the riser 7) generally convey oil or gas (or even water) from (or towards) an underwater source (for example a well) to an upper part of the turret 3, for example swivels not represented for establishing a rotatable connection with vessel-mounted equipment or piping.

The turret 3 also may support umbilicals 36 which extend downwardly through and beyond the chain table 5. The chain table 5 and turret table 8 are interconnected by a connecting structure comprises at least three columns 9 which extend vertically between the chain table 5 and the turret table 8. In FIG. 1 only one of these columns 9 has been shown.

These columns 9 are positioned at (for example regular) angular intervals (as will appear below while referring to FIG. 2) in such a manner that radially outer sides 10 of the columns 9 are located in the vicinity (or even define part) of an outer circumference of the turret 3. The risers 7 are conveyed through the chain table 5 in such a manner that sections 7' thereof above the chain table 5 extend upwards towards the turret table 8 within an internal space 11 of the columns 9.

It is noted that in FIG. 1 a riser ending 12 of the riser 7 is shown. During operation a piping (not illustrated) will be connected to said riser ending 12 for establishing a fluid path towards the turret table 8 (and other equipment, such as a swivel). Within the context of the present invention the indication 'riser' or 'riser section' also indicates such piping.

In the illustrated embodiment the columns 9 over their entire vertical extension between the chain table 5 and turret table 8 define the internal space 11 sealed (shielded) against the surroundings. In other embodiments not illustrated the columns 9 only in their lower parts (for example extending from the chain table 5 upwards to a level somewhat above sea level) define such a sealed internal space 11.

Ventilation equipment 22, e.g. ventilation openings with or without door(s) or the like to open and close the opening (s), fan(s), blower(s), air handler(s), etc., and combinations thereof, may be provided for controlling the atmosphere within the internal space (for example for discharging hazardous or dangerous gases or mixtures of gas/oil with air).

As illustrated schematically by a person 13, the dimensions of the internal space 11 (specifically its diameter) are sufficient to allow access of a person into said internal space. An access door 14 to the internal space 11 may be provided, as well as stairways 35 or ladders (here partly illustrated outside of the column 9, but possibly also inside the column).

At a vertical spacing above the chain table 5 a horizontally extending bulk head 15 is provided in the column 9 which is provided with a support member (such as a well-known hang-off support) 16 for the riser 7 (or riser section 7'). The bulk head 15 also may support an emergency shut down valve (indicated schematically at 17) or other equipment located in the vicinity of the support member 16 or riser ending 12.

As illustrated clearly in FIG. 1, the column 9 in its lower part has a tapering shape 18 with a wider lower part and a narrower upper part. The taper may substantially correspond with an angle $\alpha$ under which the riser 7 enters the chain table 5. In the illustrated embodiment the column 9 tapers only at its radially outer side 10, but in other embodiments not illustrated it (also) may taper at other sides.

Figure 2:
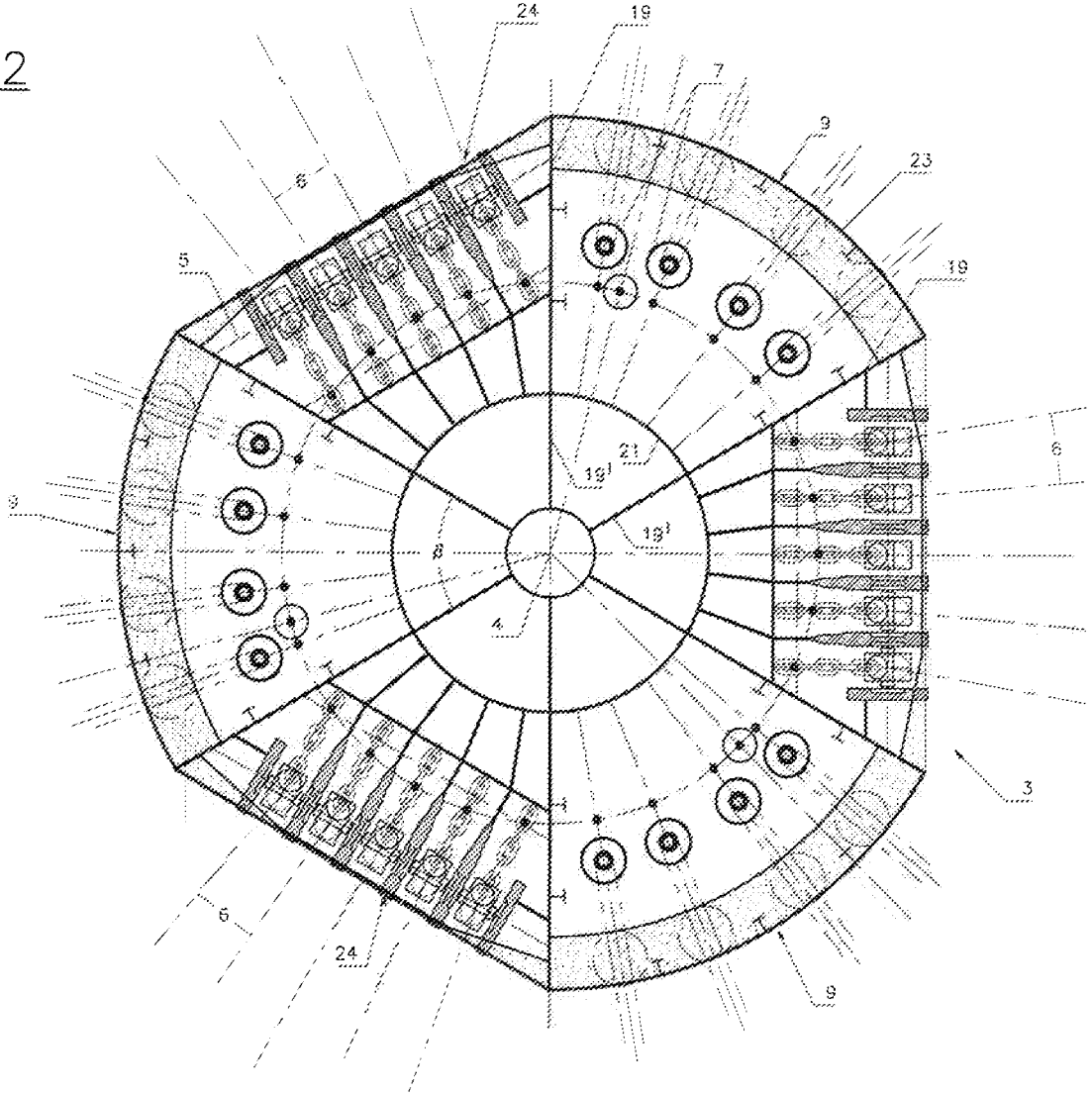
FIG. 2 illustrates a schematic view according II-II in FIG. 1.

Next reference is made to FIG. 2 which basically is a schematic representation of a view downwards according to II-II in FIG. 1. It shows three columns 9 of which lateral sides 19 are defined by two straight lines 19' extending radially outwards from the turret axis 4 and enclosing an angle $\beta$ (illustrated for the left column 9 in FIG. 2) which in this embodiment is taken as 60 degrees for illustration. The columns 9 further are defined by an inner circle segment 21 extending between said two straight lines 19' concentrically around and at a distance from the turret axis 4, and an outer circle segment 23 extending between said two straight lines 19' concentrically around the turret axis 4 and in the region of the outer circumference of the turret 3 (this outer circle segment 23 corresponds with the radially outer side 10 of a column 9). Thus, a cross section of each column 9 corresponds with a (pie-shaped) sector delimited by the sides 19 and the inner and outer circle segments 21 and 23.

In the illustrated embodiment with three columns 9 there thus are three sectors in which the angle $\beta$ is about 60 degrees. Between these sectors three additional sectors 24 are located (in this embodiment each equally spanning an angle of 60 degrees) and the mooring lines 6 (of which the number may vary) are connected to the chain table 5 at these sectors 24, thus between the columns 9 as viewed in a vertical direction.

The angles mentioned may vary, and the angles spanned by the columns (sectors) 9 may differ from the angle spanned by the additional sectors 24. In yet another embodiment the angles spanned between successive columns 9 may vary (but preferably in accordance with a regular pattern, for example a first angle between a first and second column, a different second angle between the second and a third column, again the first angle between the third and a fourth column and so forth).

The chain table 5 may comprises vertically extending bulk heads which are located such that the sides 19 of the columns 9 are defined by upper prolongations of said bulk heads (which as a result in FIG. 2 also are indicated by reference 19). Said prolongations also may coincide or correspond with vertically extending bulk heads of the turret table 8 (which then likewise would be indicated by the reference 19).

In the illustrated embodiment of the assembly in which in the moonpool 2, substantially at the level of the turret table 8, a main (upper) bearing 20 is provided between the turret 3 and the vessel 1, there is no additional bearing provided at a lower level. However, in an alternative embodiment a lower bearing or a fail-safe bearing 25, preferably a sliding bearing, may be provided at a lower level, preferably substantially at the level of the chain table 5, having cooperating bearing parts 26,27 (for example a slide ring and slide pads) at the turret 3 and at the vessel 1 which under design operational conditions do not (or may not) engage each other.

Figure 3:
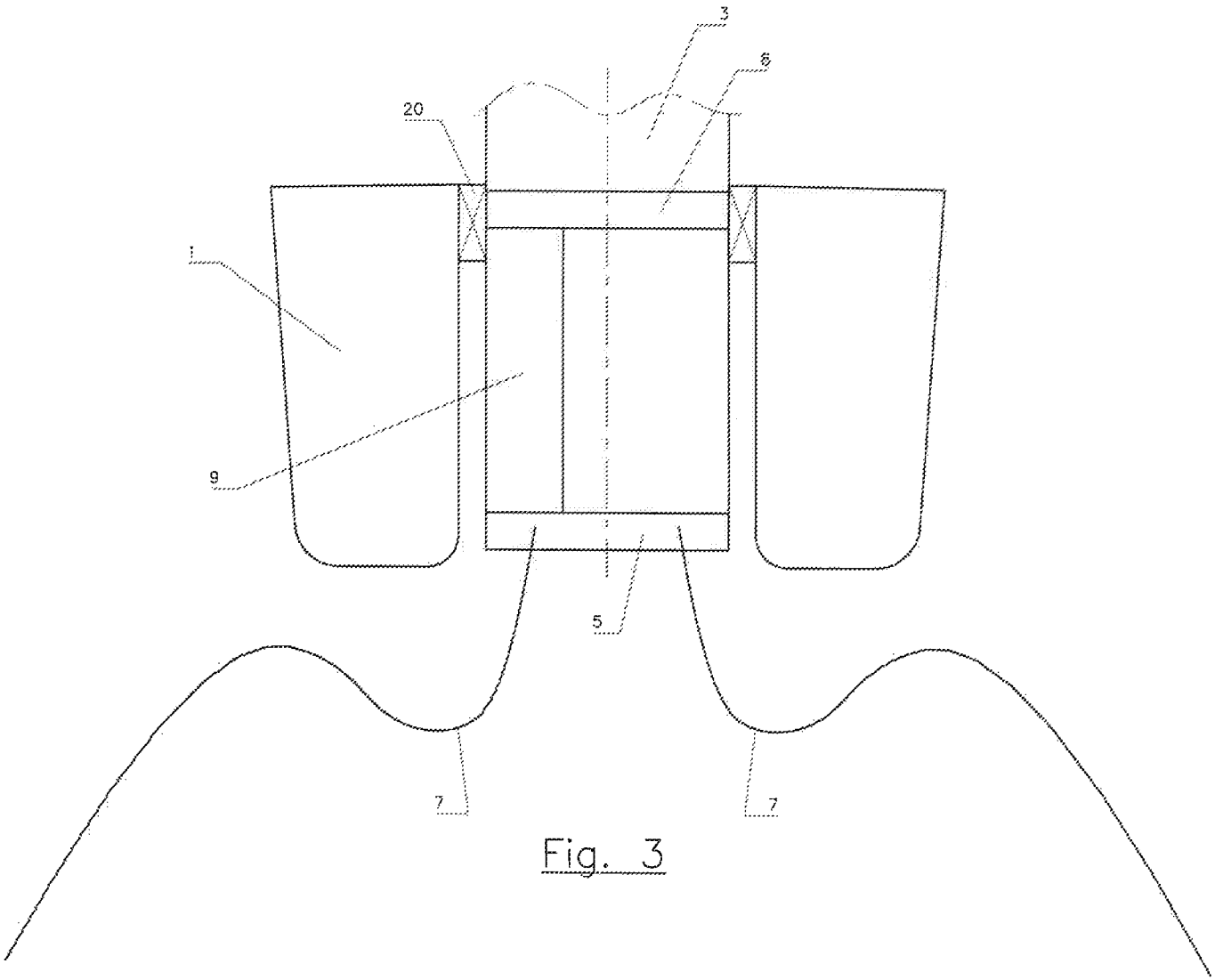
FIG. 3 illustrates the lazy wave riser concept.

Finally referring to FIG. 3, it is noted that the risers 7 may comprise any type of riser configurations and in particular steel, plastic or composite lazy wave risers. The assembly allows the use of such a riser configuration in a very effective manner without introducing detrimental loads in the turret. Further it avoids the risk of congestion, or even clashes between these lazy wave risers when hung-off above the turret table, as is typically done in turrets with flexible risers. It also allows (deliberately) angled entry of risers without the need to be pulled above water level up to or above the turret table.

The invention is not limited to the embodiments described before, which may be varied widely within the scope of the invention as defined by the appending claims.

What is claimed is:

1. An assembly of a vessel and a turret, wherein the vessel comprises a moonpool and wherein the turret is mounted in said moonpool for a rotation around a turret axis relative to the vessel, which turret comprises a chain table to which mooring lines are connected and through which risers are conveyed, and a turret table vertically spaced above the chain table and connected therewith by a connecting structure, wherein the connecting structure comprises at least three vertically extending columns positioned such at angular intervals that radially outer sides of the columns are located in a vicinity of an outer circumference of the turret and wherein the risers are conveyed through the chain table in such a way that riser sections above the chain table extend towards the turret table within an internal space of the columns, and wherein lateral sides of the columns, as viewed in a horizontal cross section, are defined by two straight lines extending radially outwards from the turret axis and enclosing an angle, an inner circle segment extending between said two straight lines concentrically around and at a distance from the turret axis, and an outer circle segment extending between said two straight lines concentrically around the turret axis and in a region of the outer circumference of the turret.

2. The assembly according to claim 1, wherein the columns at least in their lower parts connecting to the chain table define an internal space sealed against the surroundings.

3. The assembly according to claim 2, wherein the columns over their entire vertical extension between the chain table and turret table define an internal space sealed against the surroundings.

4. The assembly according to claim 3, and further comprising atmosphere control means provided for controlling the atmosphere within the internal space.

5. The assembly according to claim 3, and further comprising ventilation equipment coupled to the internal space.

6. The assembly according to claim 1, wherein each column comprises an access device configured to allow a person to pass through and into the internal space of the column.

7. The assembly according to claim 1, wherein the columns at a vertical spacing above the chain table are provided with support members configured to support the risers.

8. The assembly according to claim 7, wherein the support members are at least part of a horizontally extending bulk head.

9. The assembly according to claim 1, wherein emergency shut down valves for the risers or other equipment are located in a vicinity of the chain table or turret table.

10. The assembly according to claim 1, wherein the columns, at least in their lower parts connecting to the chain table, have a tapering shape with a wider part near to the chain table and a narrower part at a higher level.

11. The assembly according to claim 10, wherein the tapering shape at least is defined at the radially outer sides of the columns.

12. The assembly according to claim 11, wherein the risers enter the turret from below the chain table under at most a maximum angle which substantially corresponds with the tapering shape.

13. The assembly according to claim 1, wherein the mooring lines, as viewed in a vertical direction, are connected to the chain table at locations between the columns.

14. The assembly according to claim claim 1, and further comprising at least three columns.

15. The assembly according to claim 1, wherein the turret has a diameter between 15 and 20 meters and wherein a length of the straight lines between the inner and outer circle segments is between 4 and 6 meters.

16. The assembly according to claim 1, wherein the chain table comprises vertically extending bulk heads and wherein the lateral sides of the columns defined by the straight lines are prolongations of said bulk heads.

17. The assembly according to claim 16, wherein turret table comprises vertically extending bulk heads and wherein the lateral sides of the columns defined by the straight lines are prolongations of said bulk heads.

18. The assembly according to claim 14, wherein the turret has a diameter of about 17 meters and a length of the straight lines between the inner and outer circle segments is about 5 meters.

19. The assembly according to claim 1, wherein in the moonpool, substantially at a level of the turret table, a main bearing is provided between the turret and the vessel and wherein there is not provided an additional bearing at a lower level, or there is provided a fail-safe bearing, preferably a sliding bearing, at a lower level having cooperating bearing parts at the turret and at the vessel which under design operational conditions do not engage each other.

20. The assembly according to claim 1, wherein the risers comprise any type of riser configurations including steel, plastic or composite lazy wave risers.

21. The assembly according to claim 1 wherein the at least three vertically extending columns are positioned at regular angular intervals.

* * * * *